US010006425B2

(12) United States Patent
Berruet et al.

(10) Patent No.: US 10,006,425 B2
(45) Date of Patent: Jun. 26, 2018

(54) CAM FOLLOWER, INJECTION PUMP AND VALVE ACTUATOR HAVING SUCH A CAM FOLLOWER, AND MANUFACTURING METHOD

(71) Applicants: Nicolas Berruet, Artannes sur Indre (FR); François Champalou, Chaumont-sur-Loire (FR); Benoît Hauvespre, Saint Etienne de Chigny (FR); Guillaume Jouanno, Plouha (FR); Samuel Viault, Saint-Antoine-du-Rocher (FR)

(72) Inventors: Nicolas Berruet, Artannes sur Indre (FR); François Champalou, Chaumont-sur-Loire (FR); Benoît Hauvespre, Saint Etienne de Chigny (FR); Guillaume Jouanno, Plouha (FR); Samuel Viault, Saint-Antoine-du-Rocher (FR)

(73) Assignee: AKTIEBOLAGET SKF, Gothenburg (SE)

( * ) Notice: Subject to any disclaimer, the term of this patent is extended or adjusted under 35 U.S.C. 154(b) by 158 days.

(21) Appl. No.: 15/082,061

(22) Filed: Mar. 28, 2016

(65) Prior Publication Data

US 2016/0281667 A1 Sep. 29, 2016

(30) Foreign Application Priority Data

Mar. 27, 2015 (EP) ..... 15305455

(51) Int. Cl.
*F01L 1/14* (2006.01)
*F02M 59/10* (2006.01)
(Continued)

(52) U.S. Cl.
CPC ..... *F02M 59/102* (2013.01); *F01L 1/14* (2013.01); *F01M 9/104* (2013.01); *F02M 59/06* (2013.01);
(Continued)

(58) Field of Classification Search
CPC ..... F01L 1/14; F01L 2810/02; F02M 59/102; F01M 9/104
(Continued)

(56) References Cited

U.S. PATENT DOCUMENTS 3,628,629 A 12/1971 Phillips

FOREIGN PATENT DOCUMENTS

DE 1526700 A1 2/1970
DE 4334517 A1 4/1994
(Continued)

*Primary Examiner* — Ching Chang
(74) *Attorney, Agent, or Firm* — Bryan Peckjian; SKF USA Inc. Patent Dept.

(57) ABSTRACT

A cam follower is provided having a tappet that includes a cylindrical outer surface centered on a longitudinal axis and adapted to slide in a housing surrounding the tappet, a pin extending between two opposite ends along a transverse axis perpendicular to the longitudinal axis, a roller element movable in rotation relative to the pin around the transverse axis and adapted to roll on a cam, and lubrication channels for lubricating the pin and the roller. The cam follower further provides a support element mounted in the tappet and supporting the pin, and the lubrication channels include at least one pair of consecutive channels formed through the tappet and the support element. The invention also provides an injection pump and a valve actuator for a motor vehicle, each having such a cam follower. The invention finally provides a method for manufacturing such a cam follower.

13 Claims, 2 Drawing Sheets

(51) Int. Cl.

| | |
|---|---|
| ***F01M 9/10*** | (2006.01) |
| ***F02M 63/00*** | (2006.01) |
| ***F02M 59/06*** | (2006.01) |
| ***F02M 59/48*** | (2006.01) |

(52) U.S. Cl.
CPC ..... *F02M 59/48* (2013.01); *F02M 63/0001* (2013.01); *F01L 2105/00* (2013.01); *F01L 2107/00* (2013.01); *F01L 2810/02* (2013.01); *F02M 2200/852* (2013.01)

(58) Field of Classification Search
USPC ..... 123/90.35, 90.48, 90.55, 90.6
See application file for complete search history.

(56) References Cited

FOREIGN PATENT DOCUMENTS

| | | | |
|---|---|---|---|
| DE | 102006031032 | A1 | 1/2008 |
| DE | 102009013131 | A1 | 9/2010 |
| DE | 102012221604 | A1 | 5/2014 |
| EP | 468201 | A1 | 1/1992 |
| EP | 2607636 | A1 | 6/2013 |
| WO | 08068116 | A1 | 6/2008 |

CAM FOLLOWER, INJECTION PUMP AND VALVE ACTUATOR HAVING SUCH A CAM FOLLOWER, AND MANUFACTURING METHOD

CROSS-REFERENCE TO RELATED APPLICATION

This application claims priority to European patent application no. 15305455.6 filed on Mar. 27, 2015, the contents of which are fully incorporated herein by reference.

TECHNICAL FIELD OF THE INVENTION

The invention concerns a cam follower. The invention also concerns an injection pump and a valve actuator for a motor vehicle, each comprising such a cam follower. The invention also concerns a method for manufacturing such a cam follower.

BACKGROUND OF THE INVENTION

EP-A-2 607 636 discloses a cam follower comprising a tappet, a pin and a roller. The tappet extends along a longitudinal axis, while the pin and the roller are centered on a transverse axis. The tappet is formed with two lateral flanges, delimiting an intermediate gap between them and each comprising a cylindrical bore. The roller is positioned in the intermediate gap between both flanges and bores. The pin is fitted in the two bores, such that the roller is movable in rotation relative to the pin around its axis. The pin is caulked, in other words plastically deformed, on both opposite ends to create a mechanical connection by press-fit in the tappet bores.

When the cam follower is in service, the roller collaborates with a cam synchronized with the internal combustion engine camshaft. The rotation of the camshaft leads to a periodic displacement of a piston of the pump that rests against the tappet, to allow fuel to be delivered. The tappet is movable back and forth along the longitudinal axis, while the roller is movable in rotation around its central axis. The tappet is provided with lubrication channels to ensure lubrication of the interface between the roller and the cam.

SUMMARY OF THE INVENTION

The aim of the invention is to provide an improved cam follower.

To this end, the invention concerns a cam follower, comprising: a tappet having a cylindrical outer surface centered on a longitudinal axis and adapted to slide in a housing surrounding the tappet, a pin extending between two opposite ends along a transverse axis perpendicular to the longitudinal axis, a roller element movable in rotation relative to the pin around the transverse axis and adapted to roll on a cam, and lubrication channels for lubricating the pin and the roller. According to the invention, the cam follower further provides a support element mounted in the tappet and supporting the pin, and the lubrication channels include at least one pair of consecutive channels formed through the tappet and the support element.

Thanks to the invention, the shape of the tappet is simplified in comparison with a tappet supporting the pin, without support element mounted in the tappet. Moreover, the tappet and the support element can each be made of specific materials, chosen for specific conditions of operation. Besides, the lubrication channels can be formed through both tappet and support element so that the roller and its surroundings can be easily and efficiently lubricated. Thus, behavior and lifetime of the cam follower can be improved.

According to further aspects of the invention which are advantageous but not compulsory, such a cam follower may incorporate one or several of the following features:

- The consecutive channels are coaxial.
- The consecutive channels are centered on a through axis which is located in a plane including the transverse axis and the longitudinal axis.
- The consecutive channels are directed toward a longitudinal end of the tappet at which the roller element is destined to roll on the cam.
- The cam follower provides a bearing interposed between the pin and the roller element.
- The consecutive channels are directed toward a lateral face of the bearing.
- The consecutive channels are directed toward a lateral face of the roller element.
- The support element is fitted in recesses formed in the tappet.
- Each pin end is mounted between a half-cylindrical section formed in the tappet and a half-cylindrical section formed in the support element.
- The lubrication channels include two pairs of consecutive channels formed through the tappet and the support element, on either side of the longitudinal axis.
- The tappet is made of synthetic material, for example made of polyamide or polyether-ether-ketone, while the support element is a metal insert, for example made of steel.
- The tappet is provided with at least one antirotation device for preventing rotation of the cam follower in the housing around the longitudinal axis.

The invention also concerns an injection pump for a motor vehicle, comprising a cam follower as defined here-above.

The invention also concerns a valve actuator for a motor vehicle, comprising a cam follower as defined here-above.

The invention also concerns a method for manufacturing a cam follower as defined here-above. The method provides the following steps:

a) manufacturing the tappet, the support element, the pin and the roller ;

b) mounting the pin and the roller on the support element ;

c) mounting the support element in the tappet, together with the pin and the roller.

The consecutive channels are formed through the tappet and the support element in step a) or in a further step d).

BRIEF DESCRIPTION OF THE DRAWINGS

The invention will now be explained in correspondence with the annexed figures, and as an illustrative example, without restricting the object of the invention. In the annexed figures.

DETAILED DESCRIPTION OF SOME EMBODIMENTS

Figure 2:
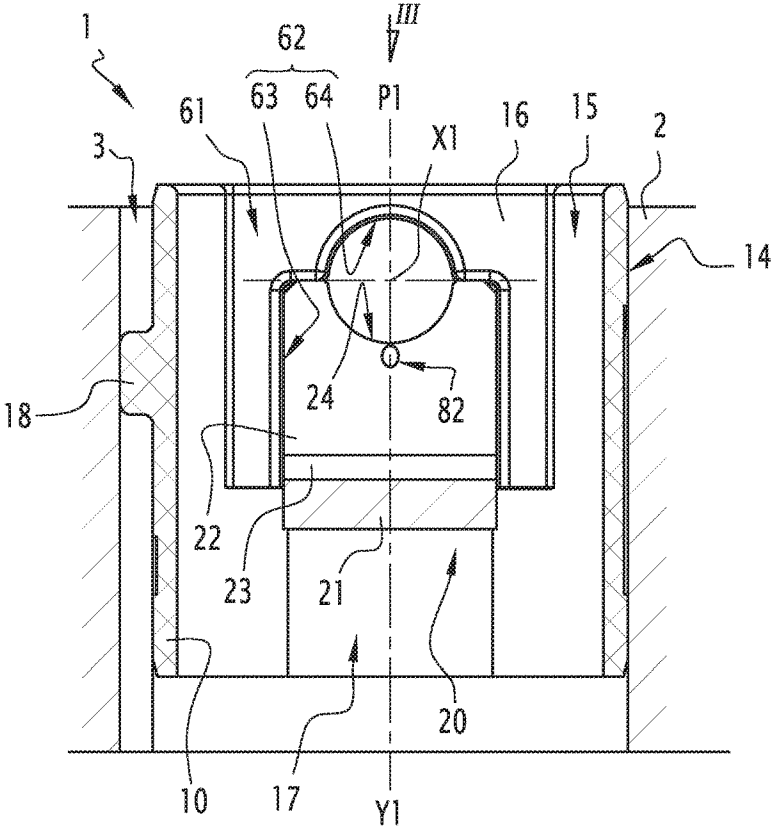
FIG. 2 is a second sectional view of the cam follower, in a second plane perpendicular to the first plane and including the longitudinal axis of the cam follower, showing only the tappet and the insert.
Figure 1:
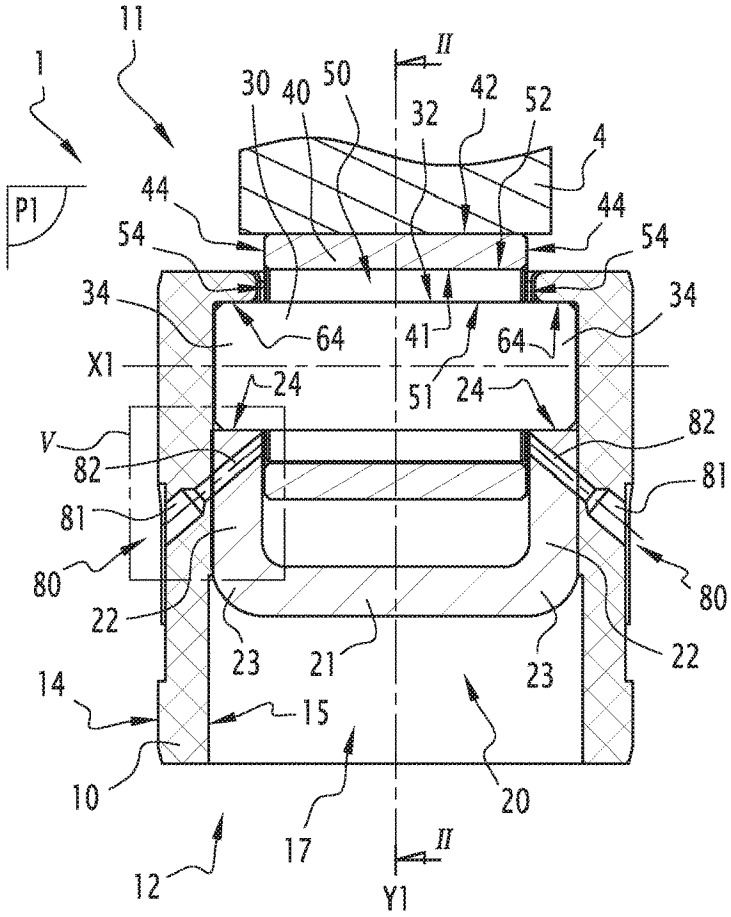
FIG. 1 is a first sectional view of a cam follower according to the invention, in a first plane including the longitudinal axis of the cam follower, showing a tappet, an insert, a pin and a roller forming the cam follower.
Figures 3, 4, 5:
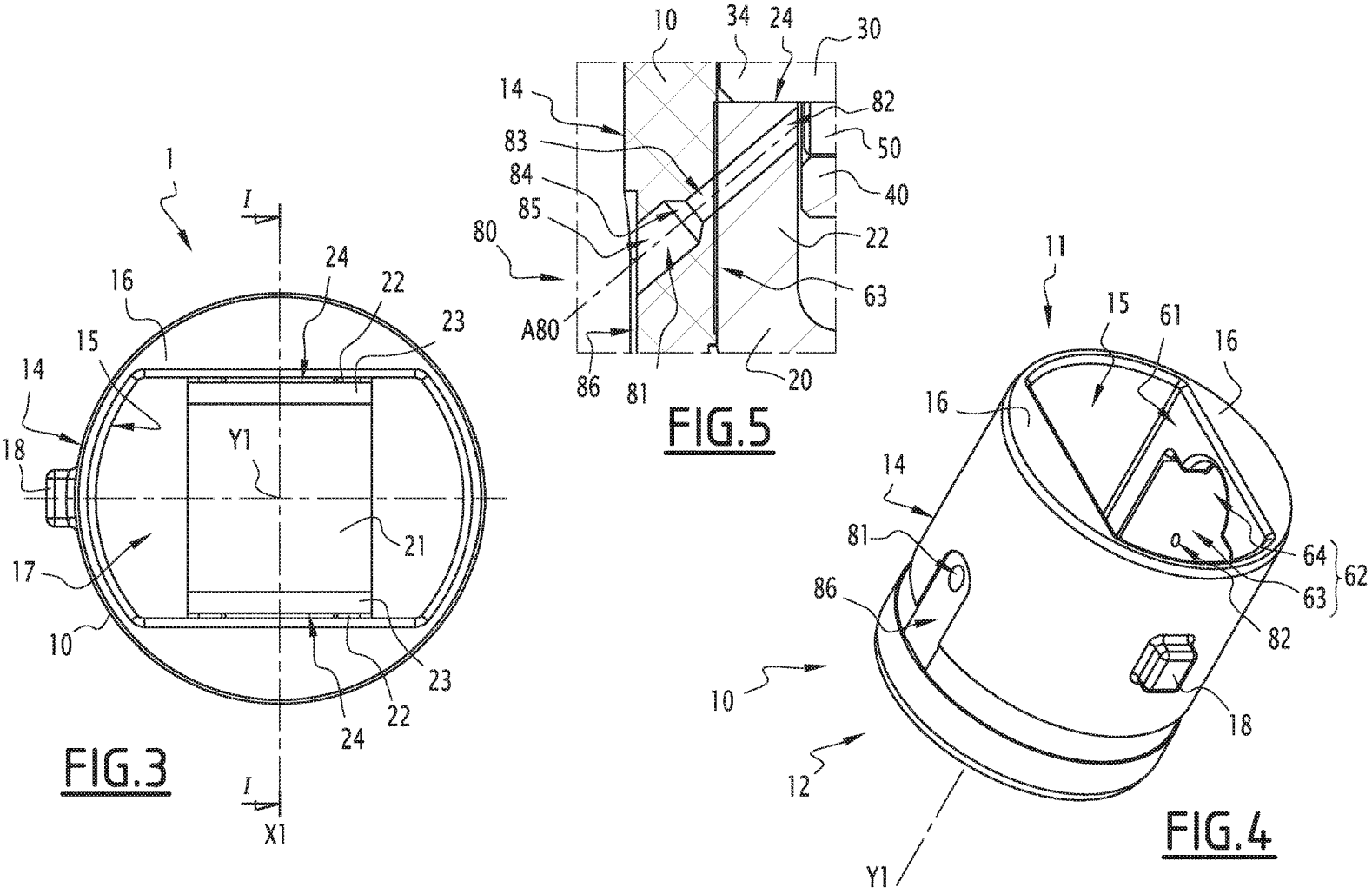
FIG. 3 is an axial view of the cam follower along arrow III of FIG. 2, showing only the tappet and the insert.
FIG. 4 is a perspective view of the tappet.
FIG. 5 is a view at a larger scale of detail V from FIG. 1.

The cam follower 1 represented on FIGS. 1 to 5 is adapted to equip a mechanical system, for example an injection pump or a valve actuator for a motor vehicle.

The cam follower 1 provides a tappet 10, an insert 20, a pin 30, a roller 40 and a bush 50, together forming a plain bearing. Pin 30, roller 40 and bush 50 are centered on a transverse axis X1, while tappet 10 is centered on a longitudinal axis Y1. Axes X1 and Y1 are perpendicular. The tappet 10 is mounted in a housing 2, represented only on FIG. 2 for simplification purpose, belonging to the mechanical system. Housing 2 is provided with a groove 3 extending parallel to axis Y1. Housing 2 is preferably made of metal. Tappet 10 is movable back and forth along axis Y1 in housing 2. Roller 40 is adapted to roll on a cam 4, shown only partly on FIG. 1 for simplification purpose.

Tappet 10 has an overall tubular shape centered on axis Y1. Tappet 10 extends along axis Y1 between two ends 11 and 12. Tappet 10 has a cylindrical outer surface 14 and a cylindrical inner bore 15. Tappet 10 also has two inner protruding parts 16, formed on either side of axis X1. Bore 15 and parts 16 delimit a cavity 17 open at both ends 11 and 12. Cavity 17 receives a shaft not shown through end 12, for moving tappet 10 along axis Y1. Surface 14 is adapted to slide in housing 2 surrounding tappet 10. Tappet 10 is provided with an outer pin 18 protruding from surface 14 and positioned in groove 3 of housing 2. This, pin 18 forms an anti-rotation device preventing tappet 10 from rotating in housing 2 around axis Y1. Tappet 10 is made of synthetic material, by example polyamide 6,6 (PA) or polyether-ether-ketone (PEEK). Material of tappet 10 is chosen as a compromise between weight, cost and resistance (to oil flow and temperature variations).

Each inner protruding part 16 has a plane surface 61 extending perpendicular to axis X1. A recess 62 is formed in part 16 and open at surface 61. Recess 62 includes a parallelepiped section 63 and a half-cylindrical section 64 in communication with each other. Sections 63 and 64 are open toward end 12 of tappet 10. Sections 64 are centered on axis X1.

Insert 20 provides a plane central portion 21 and two plane lateral portions 22. Insert 20 provides curved portions 23 connecting portions 21 and 22. Portions 22 form two lateral flanges extending parallel to axis Y1 in a bifurcated manner, from portion 21 toward end 11, on both side of axis Y1. Insert 20 provides a half-cylindrical section 24 formed in each portion 22. Portions 22 are fitted in respective recesses 62, with sections 24 centered on axis X1 and open toward sections 64. Insert 20 is preferably made of stamped metal sheet, for example made of steel. Insert 20 is assembled with tappet 10 by insertion from end 12 and force-fitting in recesses 62.

Pin 30 has a cylindrical outer surface 32 extending between two pin ends 34. Roller 40 has an inner cylindrical bore 41 and an outer cylindrical surface 42 extending between two lateral faces 44. Bush 50 has an inner cylindrical bore 51 and an outer cylindrical surface 52 extending between two lateral faces 54. Surface 32 of pin 30 is adjusted with bore 51 of bush 50, while surface 52 of bush 50 is adjusted with bore 41 of roller 40.

During assembly of cam follower 1, each end 34 of pin 30 is received in a bore centered on axis X1 and formed by sections 24 and 64. Pin, roller and bush axes merge with axis X1. Roller 40 is then adapted to roll on cam 4, more precisely surface 42 can roll on the outer surface of cam 4, while can follower 1 moves back and forth along axis Y1. When roller 40 rolls on cam 4, each section 26 bears a respective end 36 of pin 30, on which roller 40 is mounted. In other words, insert 20 forms a support element for pin 30 and roller 40.

Cam follower 1 is provided with lubrication channels 80 for providing a lubricant, for example oil, at the interface between the pin 30 and the roller 40. Thus, the lubricant allows reducing friction, on the one hand, at the interface between portions 22 of insert 20 and faces 44 of roller 40 and, on the other hand, at the interface between cam 4 and surface 42 of roller 40. Consequently, heat generation and wear are reduced, thus improving lifetime of cam follower 1.

According to the invention, the lubrication channels 80 include at least one pair of consecutive channels 81 and 82 formed through tappet 10 and insert 20, respectively. In other words, channels 81 and 82 are formed following one another through both tappet 10 and insert 20.

In the example of FIGS. 1 to 5, the lubrication channels 80 include two pairs of consecutive channels 81 and 82 formed through tappet 10 and insert 20, on either side of axis Y1. In each pair, channels 81 and 82 are centered on a through axis A80 located in a plane P1 including axes X1 and Y1. In other words, channels 81 and 82 are coaxial. Channels 81 and 82 are inclined toward end 11, at which roller 40 will roll on cam 4. Axis A80 may be inclined between 20 and 70 degrees toward end 11 relative to axis Y1, for example inclined at 45 degrees. Channels 81 and 82 are directed toward a lateral face 54 of bearing 50. Alternately, channels 81 and 82 may be directed toward a lateral face 44 of roller 40. Thus, the lubricant can be guided to the most useful location to reduce heat generation and wear between components 30, 40 and 50.

Channel 81 includes several portions 83, 84 and 85, while channel 82 is formed of a single cylindrical bore centered on axis A80. Portion 83 communicates directly with channel 82 and is formed of a cylindrical bore having the same diameter than channel 82. Portion 85 communicates directly with the outside of tappet 10 and is formed of a cylindrical bore having a larger diameter than portion 83. Portion 84 is a frustoconical bore linking portions 83 and 85. Portion 83 is open in section 63, while portion 85 is open in a groove 86 formed at surface 14. Shape of channel 81 comes from drilling.

The invention also concerns a method for manufacturing cam follower 1, comprising at least steps a), b) and c).

Step a) consists in manufacturing components 10, 20, 30, 40 and 50. Step b) consists in mounting components 30, 40 and 50 on insert 20. Step c) consists in mounting insert 20, together with elements 30, 40 ad 50, in tappet 10. Channels 81 and 82 are formed through tappet 10 and insert 20 in step a) or in a further step d). In a first embodiment, channels 81 and 82 are formed through tappet 10 and insert 20 in step a), for example by molding and/or drilling. In a second embodiment, channels 81 and 82 are formed through tappet 10 and insert 20 by drilling, in a step d) following step c).

Other non-shown embodiments can be implemented without leaving the scope of the invention.

According to a non-show embodiment, tappet 10 may provide one or several antirotation devices 18 having various shapes and/or positions. Device 18 may be formed integral with tappet 10, for example by molding, punching or machining. Alternately, device 18 may be mounted on tappet body 10, for example by clipping. Besides, tappet 10 may be provided with two or more antirotation devices 18.

According to another non-show embodiment, bush 50 may be replaced by a rolling bearing including a series of needles or rollers distributed around axis X1 between pin 30 and roller 40.

According to another non-shown embodiment, cam follower 1 may be devoid of bearing or bush 50, so that pin 30 and roller 40 form together a plain bearing. In this case, surface 32 of pin 30 is adjusted with bore 41 of roller 40. Channels 81 and 82 are directed toward a lateral face 44 of roller 40.

Whatever the embodiment, cam follower 1 provides a support element 20 mounted in tappet 10 and supporting pin 30, and lubrication channels 80 including at least one pair of consecutive channels 81 and 82 formed through tappet 10 and support element 20.

In addition, technical features of the different embodiments can be, in whole or part, combined with each other. Thus, the cam follower 1 and its manufacturing method can be adapted to the specific requirements of the application.

The invention claimed is:

1. A cam follower, comprising:

a tappet having a cylindrical outer surface centered on a longitudinal axis (Y1) and adapted to slide in a housing surrounding the tappet, a pin extending between two opposite ends along a transverse axis (X1) perpendicular to the longitudinal axis, a roller element movable in rotation relative to the pin around the transverse axis (X1) and adapted to roll on a cam, and lubrication channels for lubricating the pin and the roller, wherein the cam follower further comprises a support element mounted in the tappet and supporting the pin, wherein the lubrication channels include at least one pair of consecutive channels formed through the tappet and the support element, and wherein each pin end is mounted between a half-cylindrical section formed in the tappet and a half-cylindrical section formed in the support element.

2. The cam follower according to claim 1, wherein the consecutive channels are coaxial.

3. The cam follower according to claim 2, wherein the consecutive channels are centered on a through axis (A80) which is located in a plane (P1) including the transverse axis (X1) and the longitudinal axis (Y1).

4. The cam follower according to claim 1, wherein the consecutive channels are directed toward a longitudinal end of the tappet at which the roller element is configured to roll on the cam.

5. The cam follower according to claim 1, further comprising a bearing disposed between the pin and the roller element.

6. The cam follower according to claim 1, wherein the consecutive channels are directed toward a lateral face of the bearing.

7. The cam follower according to claim 1, wherein the consecutive channels are directed toward a lateral face of the roller element.

8. The cam follower according to claim 1, wherein the support element is fitted in recesses formed in the tappet.

9. The cam follower according to claim 1, wherein the lubrication channels include two pairs of consecutive channels formed through the tappet and the support element, on either side of the longitudinal axis (Y1).

10. The cam follower according to claim 1, wherein the tappet is made of synthetic material while the support element is made of a metal.

11. The cam follower according to claim 1, wherein the tappet is provided with at least one antirotation device for preventing rotation of the cam follower in the housing around the longitudinal axis (Y1).

12. An injection pump for a motor vehicle, the injection pump comprising:

a cam follower having;

a tappet having a cylindrical outer surface centered on a longitudinal axis (Y1) and adapted to slide in a housing surrounding the tappet, a pin extending between two opposite ends along a transverse axis (X1) perpendicular to the longitudinal axis, a roller element movable in rotation relative to the pin around the transverse axis (X1) and adapted to roll on a cam, and lubrication channels for lubricating the pin and the roller, wherein the cam follower further comprises a support element mounted in the tappet and supporting the pin, wherein the lubrication channels include at least one pair of consecutive channels formed through the tappet and the support element, and wherein each pin end is mounted between a half-cylindrical section formed in the tappet and a half-cylindrical section formed in the support element.

13. A valve actuator for a motor vehicle, the valve actuator comprising a cam follower having;

a tappet having a cylindrical outer surface centered on a longitudinal axis (Y1) and adapted to slide in a housing surrounding the tappet, a pin extending between two opposite ends along a transverse axis (X1) perpendicular to the longitudinal axis, a roller element movable in rotation relative to the pin around the transverse axis (X1) and adapted to roll on a cam, and lubrication channels for lubricating the pin and the roller, wherein the cam follower further comprises a support element mounted in the tappet and supporting the pin, wherein the lubrication channels include at least one pair of consecutive channels formed through the tappet and the support element, and wherein each pin end is mounted between a half-cylindrical section formed in the tappet and a half-cylindrical section formed in the support element.

* * * * *